US005934394A

United States Patent [19]

Fareham

[11] Patent Number: 5,934,394

[45] Date of Patent: Aug. 10, 1999

[54] DRILL MEANS

[75] Inventor: Michael Fareham, Kingswood Villas, The Hong Kong Special Administrative Region of the People's Republic of China

[73] Assignee: Bulroc (UK) Ltd., Chesterfield, United Kingdom

[21] Appl. No.: 08/916,073

[22] Filed: Aug. 21, 1997

[30] Foreign Application Priority Data

Sep. 4, 1996 [GB] United Kingdom ..... 9618390

[51] Int. Cl.[6] ..... E21B 10/32

[52] U.S. Cl. ..... 175/292

[58] Field of Search ..... 175/257, 259, 175/263, 265, 292

[56] References Cited

U.S. PATENT DOCUMENTS

| | | | |
|---|---|---|---|
| 4,817,741 | 4/1989 | Lof . | |
| 5,139,099 | 8/1992 | Hayashi et al. | 175/292 |
| 5,259,469 | 11/1993 | Stjernstrom et al. | 175/292 |

FOREIGN PATENT DOCUMENTS

563561A1 10/1993 European Pat. Off. .

*Primary Examiner*—William Neuder

*Attorney, Agent, or Firm*—Trexler, Bushnell, Giangiorgi & Blackstone, Ltd.

[57] ABSTRACT

The invention relates to drill means of the type to drill and ream a hole in the ground in advance of a trailing casing tube. Drill means able to drill an oversize hole, and yet allow the drill means to be withdrawn through the casing tube when in place in the hole are known such as in U.S. Pat. No. 3,848,683. Such means are effective but are relatively complex, and the object of the invention is to provide a relatively simple inexpensive drill means capable of drilling an average hole and enabling subsequent extraction through a casing tube. The objective is met by a construction comprising a drill head, drill bit means at the end of the drill head, the drill bit means comprising at least two segments located in corresponding recesses spread equally around the drill head, the segments being rotatably mounted and movable from an inoperative position where they lie within the confines of the outer diameter of the drill head to an operative position where they extend beyond the outer diameter of the drill head, to equal degrees.

11 Claims, 2 Drawing Sheets

DRILL MEANS

Figure 1:
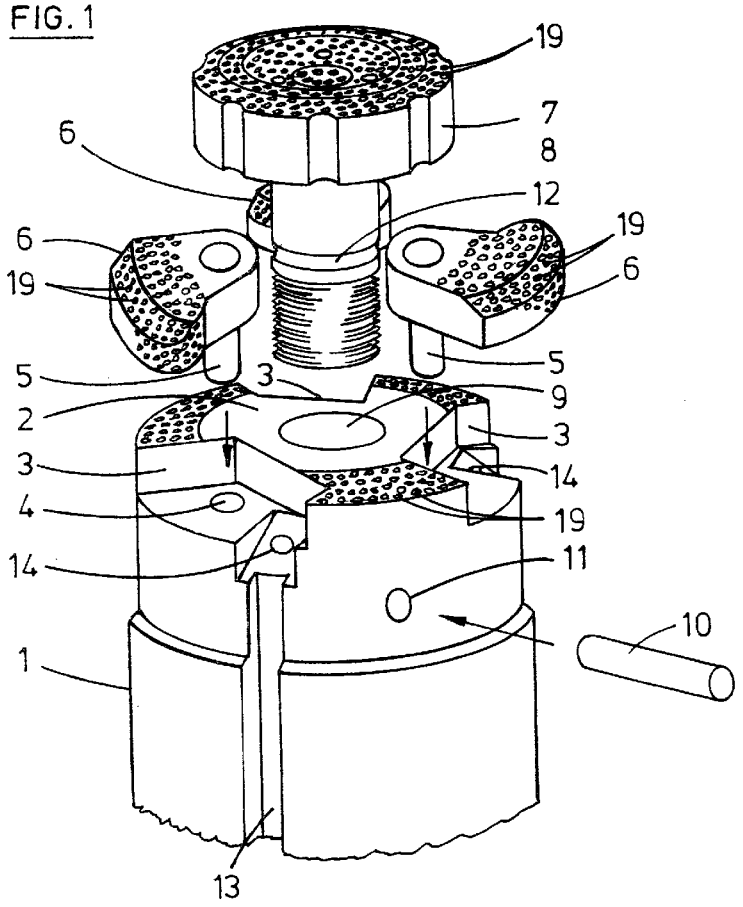

This invention relates to drill means and is particularly concerned with a drill means adapted to drill and ream a hole in the ground in advance of a trailing casing tube.

To enable the drilling of a hole to take a casing tube, it is necessary that the periphery of a drill means is at a radius greater than the radius of the casing. As at the end of the drilling operation, the drill means must be removed up through the casing that has been positioned in the drilled hole, the drill means must be capable of a radial displacement in the transverse plane from a first position where a hole at the outer diameter of the casing can be drilled to a position where the drill means is within the inner diameter of the casing and when the drill means can be withdrawn through the casing.

There are several constructions known hitherto whereby this objective can be achieved, such as, for example, as disclosed in U.S. Pat. No. 3,848,683 and in a commercially available drilling system known as the BULROC (RTM) overburden drilling system. Whilst these systems constitute a different approach to the requirement of the drilling of an oversize hole and the subsequent withdrawal of the drill through a casing tube, they have the similarity in the provision on the drill head of a complex stem with a coarse pitch helical screw to enable a relative rotation of the drill head or a reaming attachment on the drill head, about a drive means to which the drill head is secured, first to bring the drill head/reaming attachment to an eccentric position to allow the drilling of an oversize hole and then to bring the drill head/reaming attachment to within the inner diameter of the casing to permit its withdrawal.

Whilst such systems are effective, they are relatively complex and relatively expensive, and any wear on the drill head/reaming attachment results in the need to discard, or scrap, the entire drill head and stem.

In an alternative approach, that avoids those disadvantages mentioned above, as is disclosed in co-pending British Application No 9609078, a drive means has a stem projecting from the front face thereof, a drill head having a back face for abutting contact with the front face of the drive means, and having a support bore, the stem fitting the bore with freedom for the drill head to rotate relative to the drive means, at least one of the stem and support bore having an axis offset from the axis of the respective drive means and drill head, there being a means to detachably secure the drill head on the stem and prevent relative axial movement, and there being a means to limit the degree of relative rotation as between the drill head and the drive means. Despite being a noticeable improvement over the then prior art, this construction along with its prior art, results in a dill head that has a drill bit that is to be rotated to an off-centre position during the downward cutting of the bore hole, at a radial distance to produce an oversize bore hole to allow a trailing casing to be carried down the bore hole, an opposite rotation of the dull head bringing the drill bit inside the diameter of the casing and permit its withdrawal through the casing at the end of the boring operation.

As a consequence of its off-centre position, the amount of wear is considerable after but a few metres of drilling, the wear being on occasions sufficiently extreme to cause the loss of such as carbide button tips on the eccentric part of the drill bit. Also, the torsional loads on the drill bit shank caused by the eccentric disposition of the drill bit is considerable, and unless the drilling operative exercises considerable care, the torsional loads can exceed the maximum shear stress of the material of the bit shank, and that can lead to the bit head being sheared off and lost, with resultant extensive and unacceptable down time whilst the drill rods are withdrawn.

An eccentric drill bit also has the disadvantage that being part of a two-part system, the impact from the hammer on the drill head is transmitted to the bit indirectly and to an offset drill bit, with the result that considerable energy is lost, with a consequent reduction in drilling speed.

According to the present invention, a drill means comprises a drill head, a drill bit means at the end of the drill head, the drill bit means comprising at least two segments located in cooperating equally spaced recesses towards the end of the drill head, the segments each being rotatably mounted from an inoperative position where they lie within the confines of the outer diameter of the drill head, to an operative position where they extend from the outer diameter of the drill head to equal degrees.

Whilst two segments may be provided, it is preferred to provide three segments, each rotatably mounted and able to rotate through 90 degrees from the inoperative to the operative position.

To simplify the construction of the drill head, it may have a flat outermost face, perpendicular to the axis of the drill head, with recesses machined in the periphery the recesses having a hole in which is located a peg on a respective segment, and there being a central bore in the head to receive the stem of an end plate that can be locked in the bore to locate the end plate in a position overlaying the segments, to ensure their retention in the recesses.

The stem on the end plate may be a sliding fit in the bore in the head, and secured by a cross pin extending through the head and fitting a recess in the face of the stem. Preferably, both the bore and the stem are correspondingly threaded to secure the end plate in place, and a cross pin provided for additional security.

Desirably, the drill bit has a central bore to the drill body, and the stem on the end plate also having a central bore communicating with an angularly disposed air passageway through the end plate, and the drill head preferably has a number of peripheral longitudinal recesses corresponding to the number of segments. Also provided is an air passageway communicating each segment recess with a central bore through the drill head. Thus with pressure air admitted to the drill, a flow of air can be provided externally of the drill head some of which will enter the segment recesses to flush debris out of that recess and through the respective air passageway to be expelled through the central bore of the drill head, the remainder of the pressure air going to the bottom of the hole to flush debris through the air passageway in the end plate and through a central bore of its stem and to the bore of the drill head, again to carry debris away up through the hammer drill.

The exposed surface of the end plate may be provided with an array of cutting elements such as button tips, as are the surfaces of the segments facing the bottom of the hole being cut. Additionally, cutting elements such as button tips are preferably provided on the edge face of the segments facing the direction of rotation of the drill head.

Thus with the drill brought in a perpendicular disposition into contact with the ground, and the hammer and rotary drive activated, the front face of the cutting bit is introduced into the ground, when the edges of the segments pick up in the edge of the hole and are progressively swung outwards to their full operative extent. At the end of the drilling operation, an opposite rotation of the drill head has a functional effect on the segments to swing them to their inoperative position, and allow the drilling head to be withdrawn through a casing drawn down the bored hole along with the drill head during drilling.

The construction of the drill of the invention results in a concentric disposition of the cutting elements on the segments with a complete avoidance of torsional loads on the pegs on the segments, with the result that a major cause of drill failure is eliminated. To assist in the movement of the segments, each peg may be provided with a respective sleeve of an appropriate plastics material to reduce or eliminate any frictional effect that would otherwise resist the swinging of each segment between its operative and its inoperative positions. Additionally, the impact force from the hammer on the drill head is transmitted directly to the segments, with a consequent major reduction of lost energy, and a noticeable improvement in drilling speeds.

Figure 2:
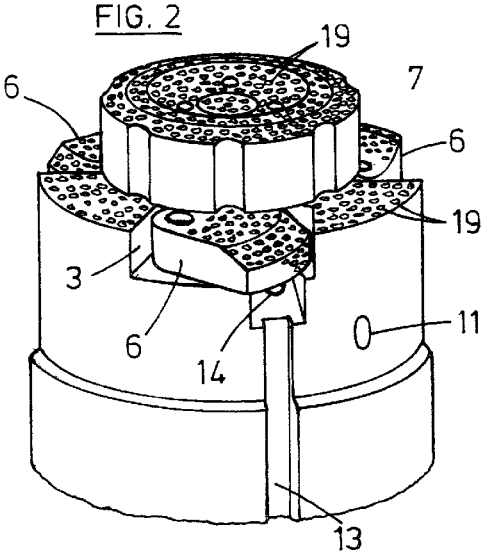
Figure 3:
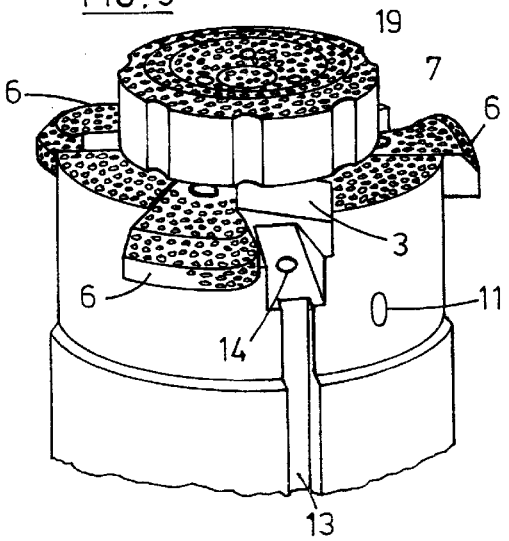
Figure 4:
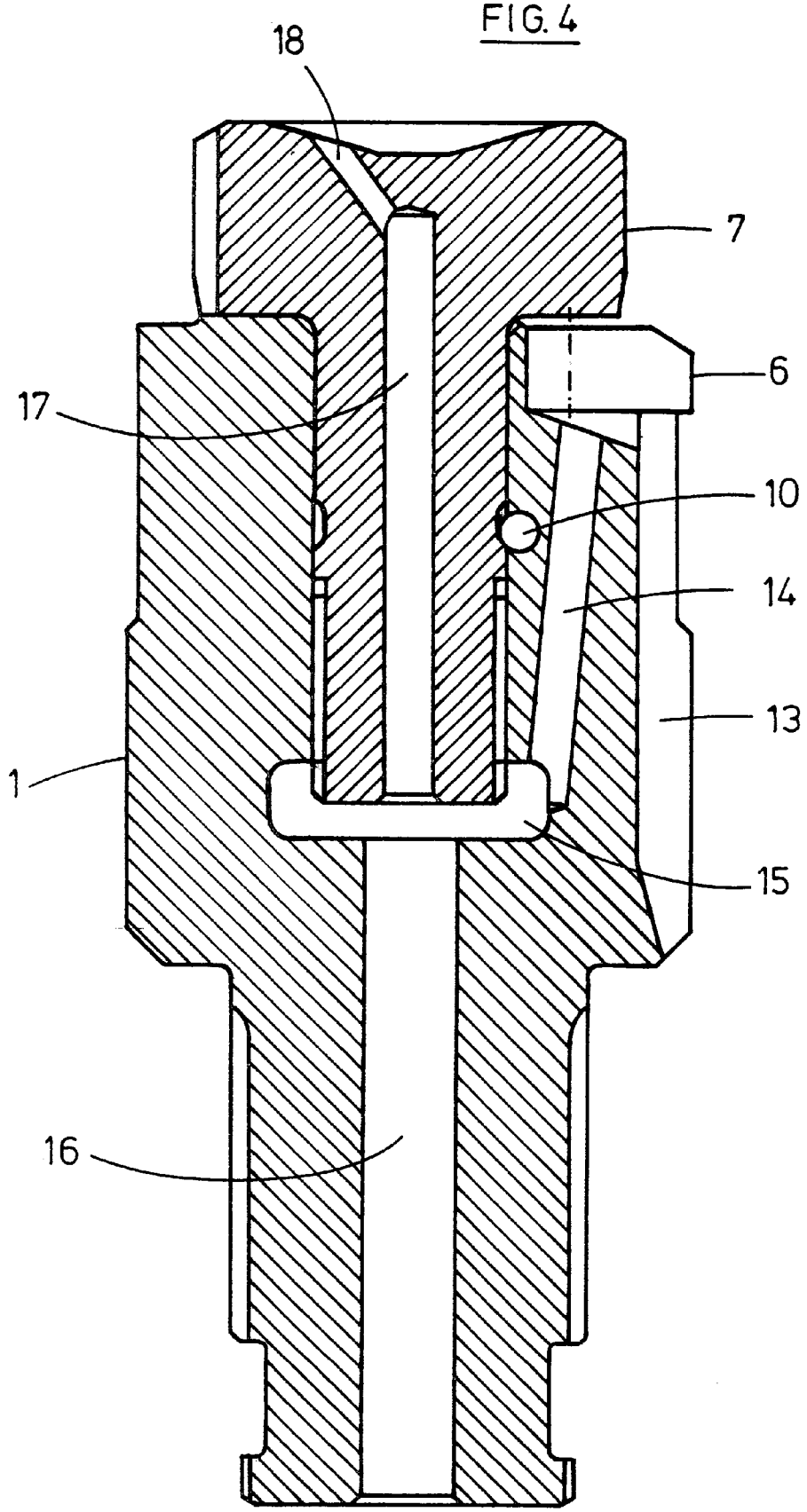

One embodiment of the invention will now be described with reference to the accompanying drawings in which:

FIG. 1 is a part schematic perspective view of the end of a drill bit;

FIG. 2 corresponds to FIG. 1 but shows the drill segments in an inoperative positions;

FIG. 3 corresponds to FIG. 1 showing the drill segments in the operative position; and FIG. 4 is a sectional side elevation of a drill bit in accordance with the present invention.

In the drawings a drill bit 1 has a flat outermost end face 2 in which are formed three recesses 3 each having a blind hole 4 to receive the pegs 5 of respective segments 6 that fit in the recesses. The drill bit has an end plate 7 having a screwed stem 8 to fit a correspondingly threaded bore 9, the arrangement being such that with the segments fitted to the recesses, they are all overlaid by the end plate and hence restrained from longitudinal movement with respect to the drill bit, whilst being left with substantial freedom to rotate about the pivotal connection formed by the respective pegs on the segments fitted in their respective holes in the recesses. For added security a locking pin 10 may pass through a transverse hole 11 through the drill bit, to locate in a corresponding recess 12 on the screwed stem 8.

The drill bit has a number of peripheral passageways 13, each to communicate with a respective recess 3 and each recess 3 has emerging therein an air passageway 14 extending to a chamber 15 formed within the drill head, which chamber 15 communicates with a central bore 16 through the drill bit. The stem 8 of the end plate 7 also has a central bore 17 extending to at least one angled air passageway 18 emerging in the end face of the end plate.

At the commencement of operations, the drill bit is in the condition shown in FIG. 2. With the drill bit having a number of button bits 19 in the end face of the end plate 7 and one the exposed peripheral surface of the drill bit, the drill head can be place in ground contact and simultaneously rotated and hammered to introduce the drill bit below ground. As the drill bit enters the ground, further button bits on a forward shoulder of each segment pick up on the ground and as a consequence of the rotation of the drill bit are brought to the condition shown in FIG. 3, whereby to cause the drilling of an oversize hole whereby to allow a lining tube to be drawn into the hole behind the drill bit as the hole is drilled. At the end of drilling operations, a reverse rotation of the drill bit has the opposite effect on the segments to draw them back into their respective recesses and to the FIG. 2 condition to permit the drill bit to be retracted through the casing.

During the drilling stage, pressure air supplied to the drill to activate its hammer is diverted externally of the drill bit, from where it can pass down the recesses 13 to the bottom of the hole, some of that air passing through the passageways 14 to assist in the flushing of debris out of the respective recess 3, the remainder of the air passing through the passageway(s) 18 to flush debris from the bottom hole up through the bore of the stem 8 and through the bore 16 of the drill bit.

I claim:

1. A drill means comprising a drill head, a drill bit means at the end of the drill head, the drill bit means having at least two segments located in co-operating recesses spread equally around the drill head, the segments each being rotatably mounted and movable from an inoperative position where they lie within the confines of the outer diameter of the drill head to an operative position where they extend beyond the outer diameter of the drill head to equal degrees, the drill head having a flat outermost face perpendicular to the axis of the drill head, each recess having a hole in which is located a peg on a respective segment, and there being a central bore in the head to receive a stem of an end plate, the stem being lockable in the bore to locate the end plate in a position overlying the recesses and the segments in the recesses.

2. A drill means as in claim 1 wherein three segments are provided, each rotatably mounted and able to rotate through 90° from the inoperative to the operative position.

3. A drill means as in claim 1 wherein the holes for the pegs are sleeved with a low friction material.

4. A drill means as in claim 1 wherein the stem on the end plate is a sliding fit in the bore in the head, and is secured by a crosspin extending through a cross-hole in the head and fitting a recess in the stem.

5. A drill means as in claim 1 wherein the stem on the end plate and the bore in the head are correspondingly threaded.

6. A drill means as in claim 1 wherein the drill head has a central bore, and a peripheral longitudinal recess extending from each segment-containing recess.

7. A drill means as in claim 6 wherein the drill head has a number of passageways corresponding to the number of recesses, connecting the recesses to the central bore of the drill head.

8. A drill means as in claim 1 wherein the stem on the end plate has a central bore extending from its inner end to a bleed passageway connecting the inner end of the bore to the outer surface of the end plate.

9. A drill means as in claim 1, wherein the exposed surface of the end plate has an array of cutting elements.

10. A drill means as in claim 1, wherein the exposed surfaces of each segment are provided with cutting elements.

11. A drill means as in claim 10 wherein the cutting elements are button bits.

* * * * *